US011300255B2

(12) United States Patent
Tsai

(10) Patent No.: US 11,300,255 B2
(45) Date of Patent: Apr. 12, 2022

(54) REPLACEABLE LIGHTING SYSTEM FOR ARTIFICIAL CHRISTMAS TREES AND OTHER DECORATIONS

(71) Applicant: Cheng-che Tsai, Shenzhen (CN)

(72) Inventor: Cheng-che Tsai, Shenzhen (CN)

(73) Assignee: Evergreen Tree Limited, Hong Kong (CN)

( * ) Notice: Subject to any disclaimer, the term of this patent is extended or adjusted under 35 U.S.C. 154(b) by 0 days.

(21) Appl. No.: 17/103,400

(22) Filed: Nov. 24, 2020

(65) Prior Publication Data

US 2021/0071826 A1 Mar. 11, 2021

Related U.S. Application Data

(63) Continuation-in-part of application No. 16/232,006, filed on Dec. 25, 2018, now Pat. No. 10,845,011.

(51) Int. Cl.

| | |
|---|---|
| ***F21S 4/10*** | (2016.01) |
| ***F21V 23/06*** | (2006.01) |
| ***F21V 23/04*** | (2006.01) |
| *F21Y 115/10* | (2016.01) |

(52) U.S. Cl.

CPC ..... *F21S 4/10* (2016.01); *F21V 23/04* (2013.01); *F21V 23/06* (2013.01); *F21Y 2115/10* (2016.08)

(58) Field of Classification Search

CPC ..... F21S 4/10; H05B 33/0827; F21V 23/06; F21V 23/001; F21W 2121/04; F21Y 2115/10

See application file for complete search history.

(56) References Cited

U.S. PATENT DOCUMENTS

| | | | | |
|---|---|---|---|---|
| 6,805,579 | B2 ‡ | 10/2004 | Marchand | H01R 13/443 174/71 R |
| 6,892,397 | B2 * | 5/2005 | Raz | A41D 19/0157 2/160 |
| 2003/0198048 | A1 * | 10/2003 | Frederick | H05B 39/00 362/249.01 |
| 2006/0039147 | A1 ‡ | 2/2006 | Wu | H05B 37/0272 362/249.16 |
| 2007/0138968 | A1 ‡ | 6/2007 | Chang | H01R 31/065 315/185 R |

(Continued)

*Primary Examiner* — Tracie Y Green

(74) *Attorney, Agent, or Firm* — Dunlap Bennett & Ludwig, PLLC

(57) ABSTRACT

A system of lighting for an artificial tree or other decoration that allows easy replacement of small sub-strings of luminaries. Each sub-string contains N luminaries, where N is an integer around 10, where the N luminaries are wired in series. Extender cables can be supplied that contain parallel splits so that the different sub-strings are operated in parallel. The extender cable can attach to a master power source that supplies the constant voltage needed to power each sub-string. The exact voltage is determined by the number N and by the voltage requirement for each of the luminaries. Each sub-string has a plug that mates with a receptacle on either an extender cable, or on the master power device. Single point failures only cause one sub-string to go dark. The physical arrangement with plugs and receptacles allows easy replacement of an individual sub-string that is dark because of a failed luminary.

18 Claims, 13 Drawing Sheets

(56) References Cited

U.S. PATENT DOCUMENTS

| | | | | |
|---|---|---|---|---|
| 2007/0217209 | A1‡ | 9/2007 | Wong | H05B 33/0842<br>362/418 |
| 2010/0090851 | A1‡ | 4/2010 | Hauser | H01R 25/003<br>340/657 |
| 2013/0301246 | A1‡ | 11/2013 | Chen | A41G 1/005<br>362/123 |
| 2015/0070878 | A1‡ | 3/2015 | Yu | H05B 45/00<br>362/123 |
| 2017/0184284 | A1‡ | 6/2017 | Van Winkle | F21V 23/001 |
| 2018/0048085 | A1* | 2/2018 | Fuda | H01R 13/44 |
| 2018/0316201 | A1‡ | 11/2018 | Miller | H01R 13/6666 |
| 2020/0348012 | A1* | 11/2020 | Park | F21V 23/005 |

* cited by examiner
‡ imported from a related application

Prior Art

Each tier wired in series.

REPLACEABLE LIGHTING SYSTEM FOR ARTIFICIAL CHRISTMAS TREES AND OTHER DECORATIONS

This is a Continuation-in-Part of application Ser. No. 16/232,006 filed Dec. 25, 2018. Application Ser. No. 16/232,006 is hereby incorporated by reference in its entirety.

BACKGROUND

Field of the Invention

The present invention relates generally to the field of artificial holiday decorations and more particularly to a replaceable lighting system for such decorations.

Description of the Problem Solved

Artificial Christmas trees are gradually replacing natural trees for reasons of safety, tidiness, ecology and economics. Other artificial lighted decorations enjoy widespread application for lighting houses and buildings during holiday seasons.

A major problem with lighting systems for artificial trees and decorations is that the numerous small light bulbs, or more recently, the numerous small LED devices are operated in series. This means that even a single light failure takes the entire string down. In the case of artificial trees, a single light failure generally takes at least one third of the tree down. In older systems, individual bulbs could be removed and replaced; however, even with this ability, it was very difficult to find the bad bulb. If more than one bulb was bad, it was virtually impossible to fix the string. Newer LED systems do not permit the LEDs to be removed at all. Thus a single LED failure on a typical modern light string dooms the entire string to becoming trash. When major portions of artificial trees fail, again through a single bulb or LED failure, the typical response is to purchase a new working string and wrap it around the portion of the tree that is out. This leads to tangled wires, some lights out with some lights on, and portions of the tree that are not lighted and other similar problems.

It would be very advantageous to have an artificial tree, artificial decoration lighting system with many different sub-strings, each having only a few lights, and with each sub-string being individually replaceable.

SUMMARY OF THE INVENTION

The present invention relates to a system of lighting for artificial Christmas trees or other decorations that allows easy replacement of small sub-strings of luminaries such as LEDs. Each sub-string contains N luminaries, where N is an integer around 10 and most probably less than 15, where the N luminaries are wired in series. Extender cables can be supplied that contain parallel splits so that the different sub-strings are operated in parallel. The extender cable, or any sub-string, can attach to a master power source that supplies the constant voltage needed to power each sub-string. The exact voltage is determined by the number N and by the voltage requirement for each of the luminaries. Each sub-string has a plug configured to mate with a receptacle on either an extender cable, or on the master power device. Single point failures only cause one sub-string to go dark. The physical arrangement with plugs and receptacles allows easy replacement of an individual sub-string that is dark because of a failed luminary.

DESCRIPTION OF THE FIGURES

Attention is now directed at several figures that illustrate features of the present invention.

Figure 1:
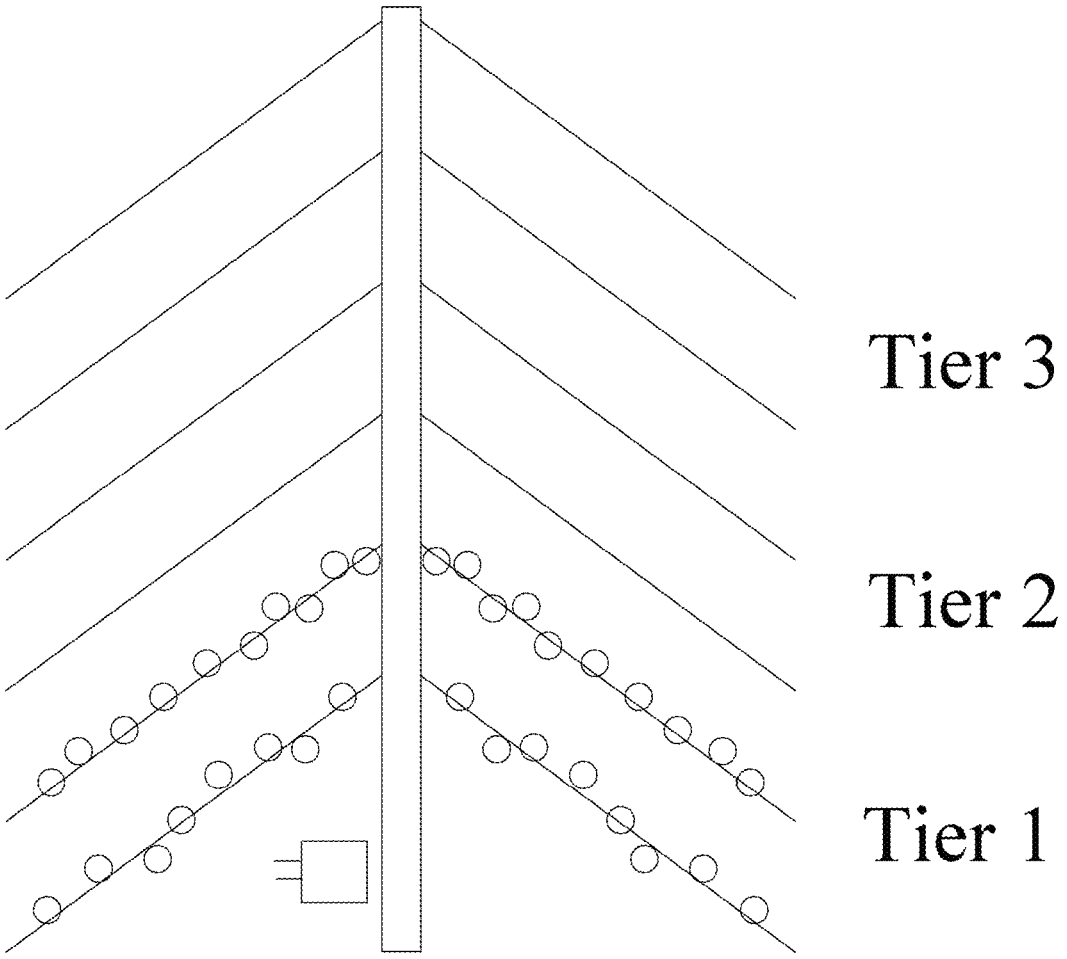
FIG. 1 shows a prior art artificial Christmas tree with three tiers.

Several figures have been presented to aid in understanding the present invention.

The scope of the present invention is not limited to what is shown in the figures.

DESCRIPTION OF THE PREFERRED EMBODIMENTS

Artificial Christmas tree and decoration lighting are operated in series in order to keep the current in each string small. LEDs and bulbs draw fairly heavy currents. Any attempt to operate the large number of LEDs or bulbs in parallel will result in a multiplication of the lamp current by the number of luminaries in the string. To prevent wire over-heating, these higher currents have to be carried in larger gauge wires. Hence, a parallel lighting system design requires large diameter wires everywhere. This result is totally unacceptable in the artificial decoration and tree industry. Larger diameter wire is bulky and expensive, with its cost increasing non-linearly with wire gauge. Hence, all artificial trees and other artificial decoration lighting are operated in series. A string with thirty LEDs draws exactly the same current as a string with one LED (but with a thirty times higher drive voltage). Hence, the wire size can be minimized safely. Since small lamps and LEDs only require a small voltages across them to light, the total series voltage of a long string rarely can be made to equal the wall voltage, or a fraction of the wall voltage.

Prior art series strings contain a large number of lights wired in series, with the total required voltage to the string being computed based on the number of lights in the string and the type of light (bulb or LED). However, since power supplies are one of the most expensive parts of the system, the tendency has been to operate as many lights as possible on a string with a single power supply that is usually located near the wall-voltage interface, or, in the case of bulbs, to run the total count up to the line voltage. This results in the problem previously described: a single light failure (or any single point failure) results in a large number of dark lights and the string (or entire tree) typically being thrown in the trash.

The present invention solves this problem by using clusters of sub-stings, each of which only has a few lights (typically ten or less) in series. Each sub-string is equipped with a miniature plug that allows it to be plugged into a master power device or into an extender cable from a master power device. The master power device supplies exactly the correct voltage to operate a single sub-string. If a single LED in the sub-string fails, only that small sub-string goes dark. It is easily replaced with a good sub-sting by simply unplugging the sub-string plug from the power device or extender cable, removing it from the tree or decoration, and replacing it with a new, good sub-string. A number of different sub-strings can be attached in parallel with the extender cable or cables. These cables have a male plug on one end that attaches to the master power device or into a previous extender cable and one or more parallel splits. Each split has a female receptacle adapted to receive the male plug from a sub-string. Typical splits are 1:3 or 1:4 or more. The female receptacles on a typical Christmas tree are configured so that the female sockets for the sub-string are arranged at or adjacent to the trunk of the tree so that it is possible to wrap a single sub-string around a single branch.

While it is theoretically possible for the master power device to fail, the probability of that happening is much smaller than the probability of an LED failing. Hence, the failure of a sub-string can almost always be fixed within several minutes. Artificial trees and decorations using this system can be supplied with several spare sub-strings at purchase, and sub-strings can also be purchased at the retail location that sells the tree or decoration much as light bulbs are.

Turning to FIG. 1, a prior art artificial Christmas tree can be seen. Except for very small trees, the tree generally has two or three tiers of separate lights. The tree shown in FIG. 1 has three tiers. This is done because putting all the lights on a larger tree in series results in a drive voltage that exceeds safety requirements. For the tree of FIG. 1, a single LED failure results in one-third of the tree going dark with no way to replace the bad string. The consumer typically winds a separately powered light string around the dark area, and then trashes the tree after the holidays.

Figure 2:
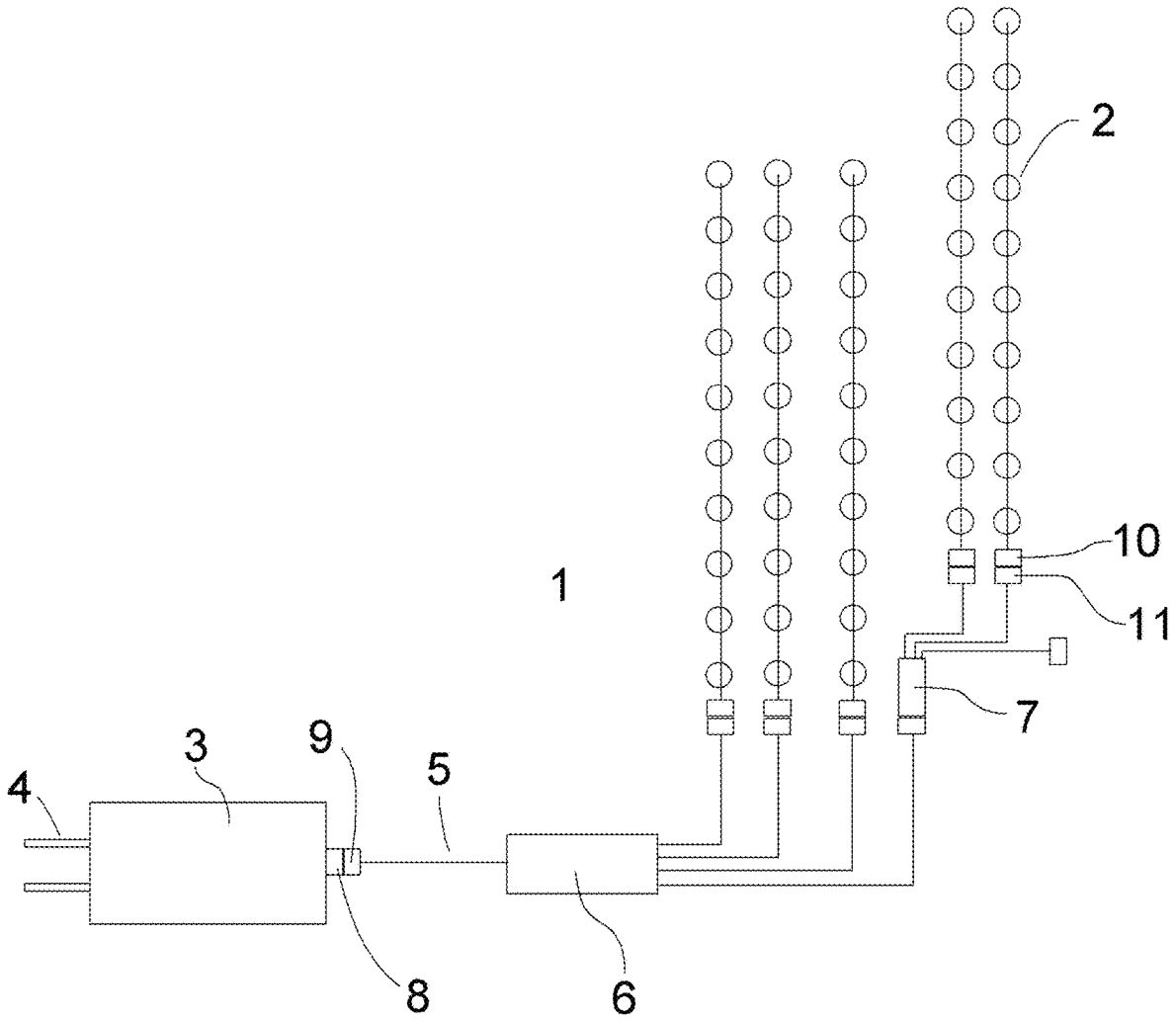
FIG. 2 shows a cluster of sub-strings.

FIG. 2 shows a typical light cluster according to the present invention. The light cluster 1 includes several sub-strings 2. Each sub-string in this example has ten LEDs. This number is for example only, any number of LEDs or other luminaries can be placed in a sub-string. However, the principle is to keep the total number of luminaries in the sub-string small, usually less than 15. FIG. 2 also shows a master power device 3 with 120 volt wall interface prongs 4, and an extension cable 5. The extension cable 5 has a first parallel split 6 that splits 4-ways. Three of these splits terminate in sub-strings 2; however, the fourth is tied to a second splitter 7. The distal end of the extension cable 5 has a male plug 8 that mates to a female plug 9 on the master power device 3. Throughout the system, the male plugs 10 on the sub-strings mate to female plugs 11 on the extension cable. Since, in the preferred embodiment, all plugs and receptacles are the same physical size, any plug can mate into any receptacle. The voltage across each receptacle is constant—the voltage required to operation one sub-string.

Figure 3:
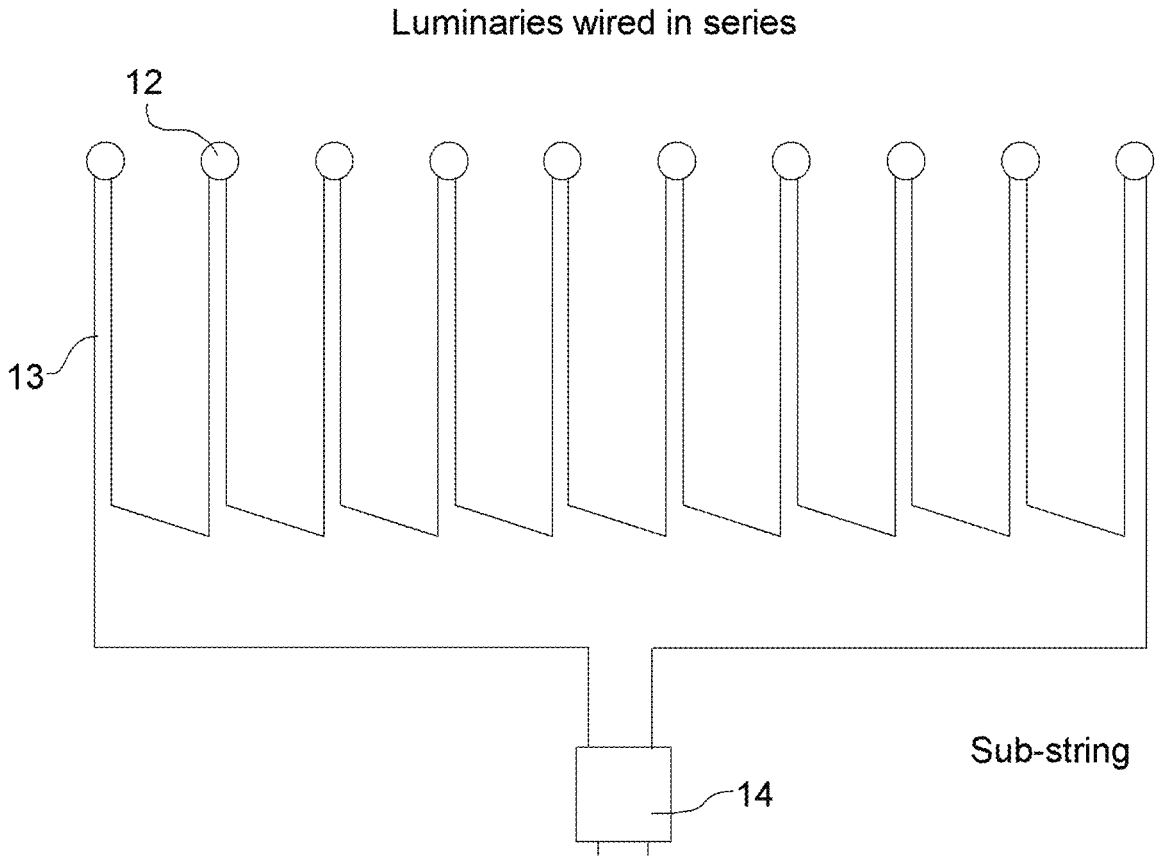
FIG. 3 shows a typical sub-string.

FIG. 3 shows an embodiment of a sub-string. The physical wires of the sub-string are arranged so that each LED 12 is at the end of a single pair of wires 13 about 10 inches long. An alternate embodiment is a ribbon with the LEDs located along a ribbon with the LEDs separated about 6-10 inches from one-another. The LEDs in the sub-string are wired in series. Each sub-string has a 2-prong male plug 14 that mates into a receptacle of an extender cable or the master power device. Multiple sub-strings form a cluster of luminaries.

Figure 4:
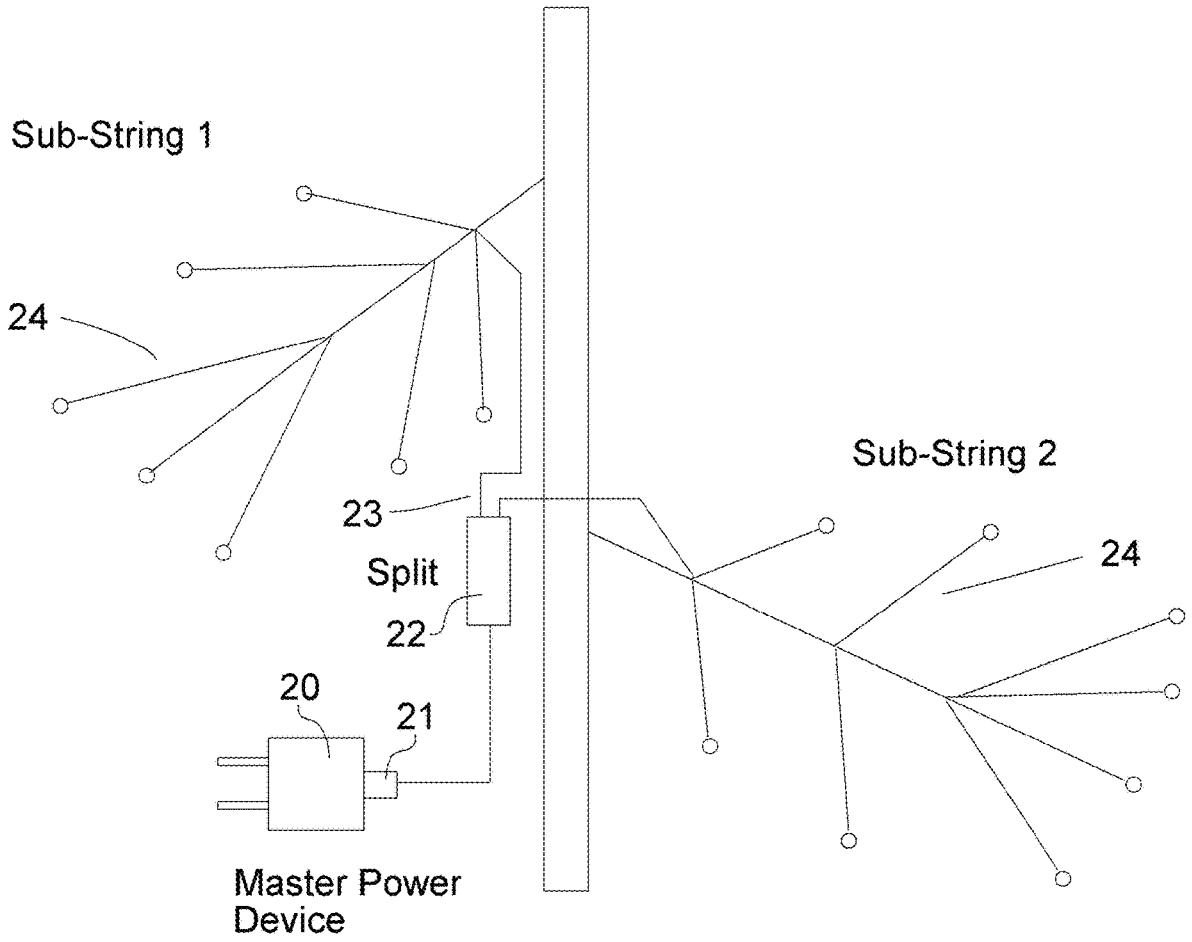
FIG. 4 shows schematic wiring of one tier of an artificial Christmas tree.

FIG. 4 shows a wiring diagram for an artificial Christmas tree according to the present invention. A master power device 20 acts as a house wiring interface with a two-prong 120 volt plug for U.S. applications. The master power device 20 in this application supplies a DC voltage of approximately 30 volts (this voltage can vary depending upon the number N of luminaries in a sub-string). The only requirement on the master power device is that the voltage stays within a required safety range, and that it is able to supply enough current for the number of parallel sub-strings in the cluster. A plug 21 plugs into the master power device 20 and runs out to a splitter 22 that parallels two wire pairs 23. Each of the wire pairs will see the 30 volts from the supply. Each of these wire pairs can either drive a sub-string of lights 24, or can be further split. Typically, the extension wires in the sub-strings are wound around branches in their final configuration.

With this arrangement, the voltage at each point in the system (outside of a sub-string) is constant (30 volts DC for the examples given). This results in the ability to plug any sub-string or any extender into any plug in the system. For example, a sub-string can be plugged directly into the master power device, or the sub-string can be plugged into any output of any splitter. The total number of plugs is chosen so that the final required current over all the splits does not exceed the maximum current the master power device can supply (around 0.12 amperes in this example). Because the master power device has some regulation capability, its output voltage does not vary much over a wide range of loadings. Thus, no matter how many sub-strings are plugged in (or left open), or how many have failed, the working LEDs see the correct voltage and are not stressed by an over-voltage.

A large Christmas tree will generally still be divided into tiers with a master power device and cluster lighting each tier or a cascade of power devices. The difference between the present invention and the prior art is that when an LED on a tier fails, only a sub-string goes dark instead of the entire tier. The dark sub-string is easily located, unplugged and replaced with a good sub-string. Replacement is fairly simple even with the luminary leads wrapped around the branches of the tree, because the leads on each LED are only 6-10 inches long.

Figure 5:
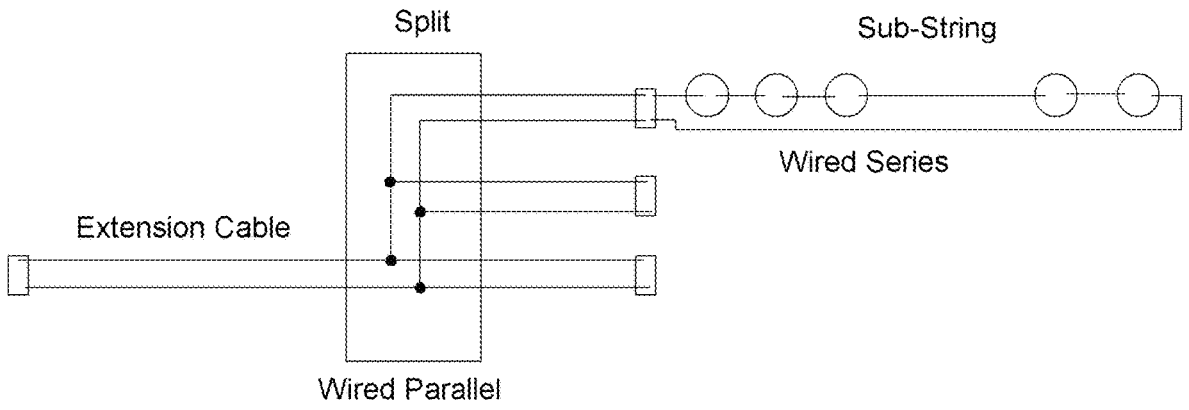
FIG. 5 shows the wiring of an extension cable, split and sub-string.

FIG. 5 shows the wiring of an extension cable, a split and a sub-string. It can be seen that the split is wired in parallel, while the sub-string is wired in series.

It is within the scope of the present invention to use several different sub-strings that have different voltages. This arrangement provides more flexibility in the number of luminaries per sub-string at the cost of more complex power supply requirements (multiple power supplies or tapped power supplies). If this is done, different plug/receptacle arrangements should be used to prevent plugging a sub-string into the wrong voltage. In general however, the simple arrangement of all sub-strings having the same voltage is the most cost effective since any plug can plug into any receptacle, and only one master power device is required.

Figure 6:
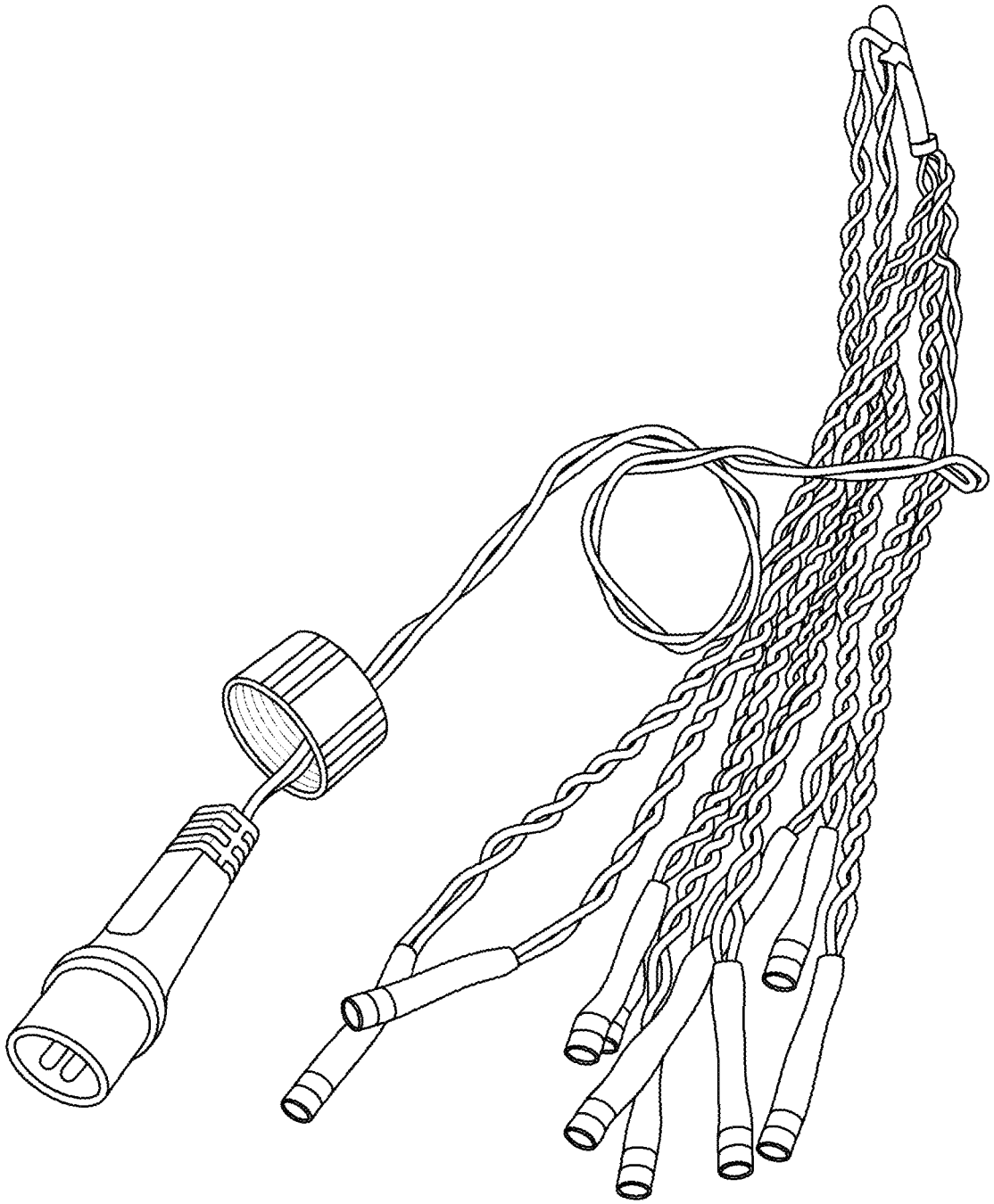
FIG. 6 shows an embodiment of a sub-string with a male plug.
Figure 7:
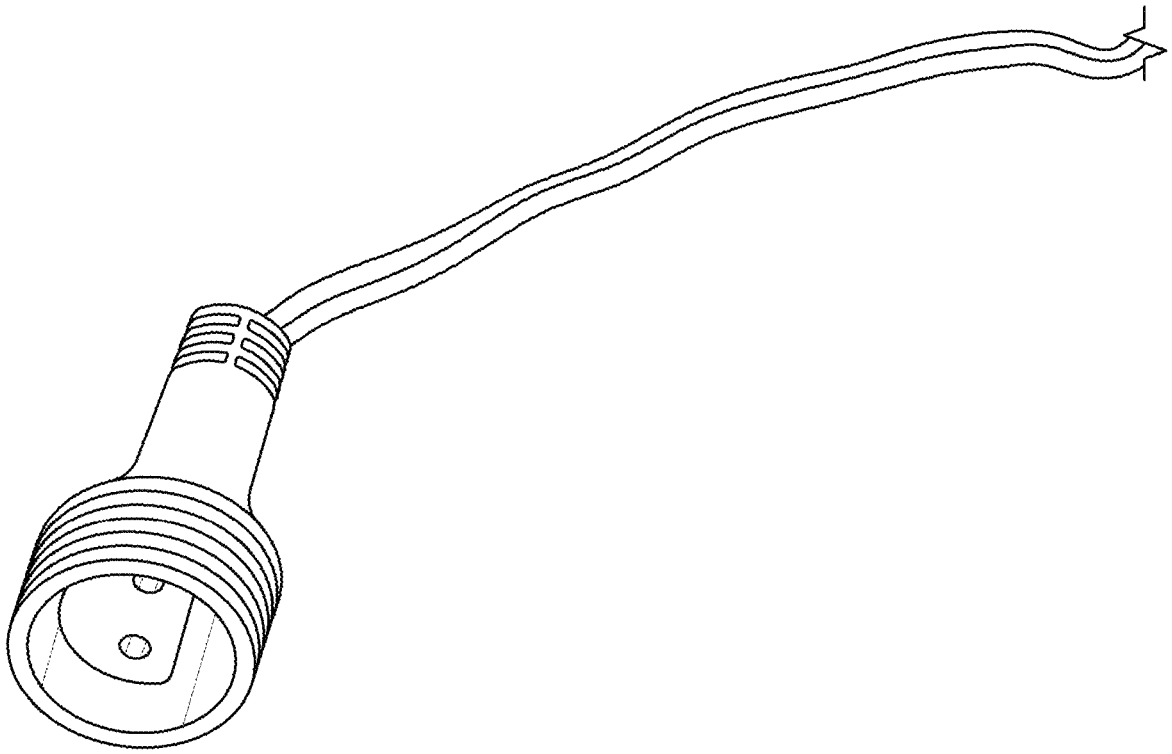
FIG. 7 shows an embodiment of a female receptacle.
Figure 8:
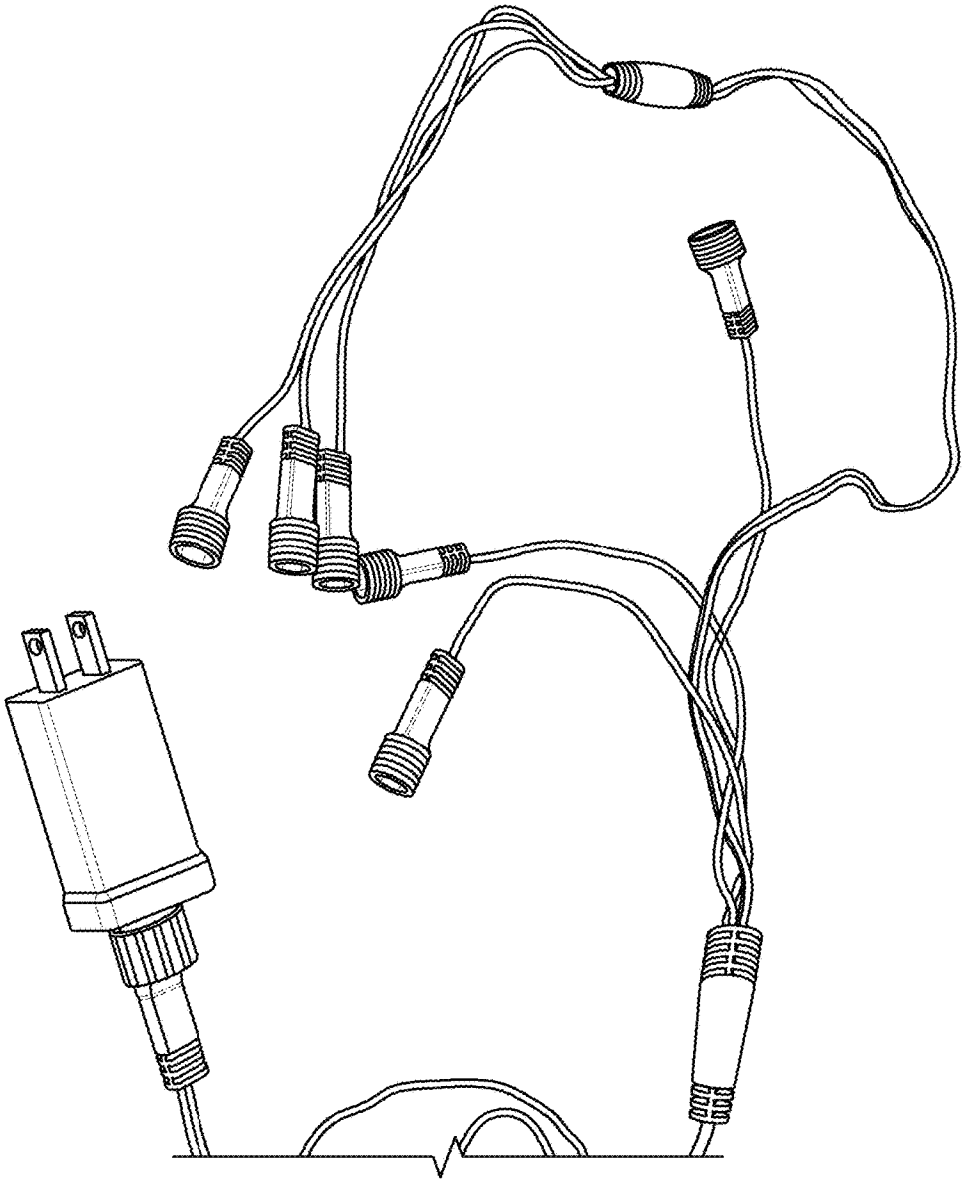
FIG. 8 shows an embodiment power module driving two splitters.

FIG. 6 shows an embodiment of a sub-string with a male plug; FIG. 7 shows an embodiment of a female receptacle, and FIG. 8 shows an embodiment power module driving two splitters.

Figure 9:
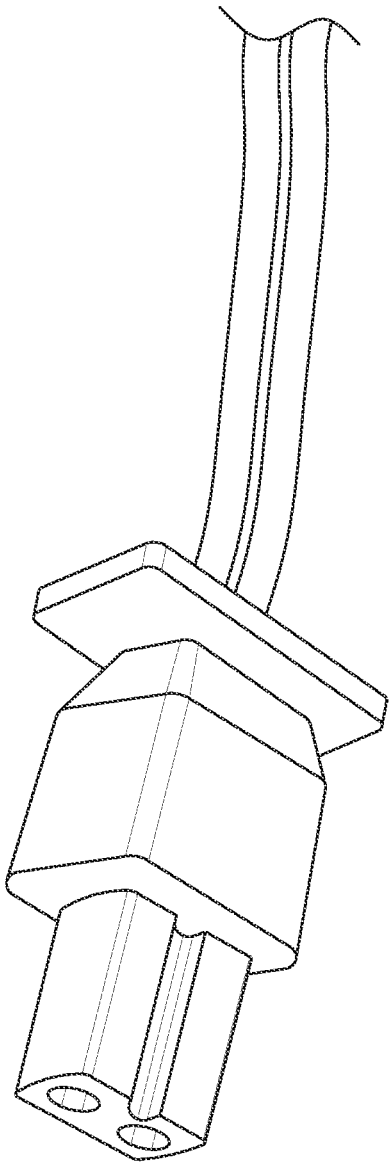
FIG. 9 is an embodiment of plug.
Figure 10:
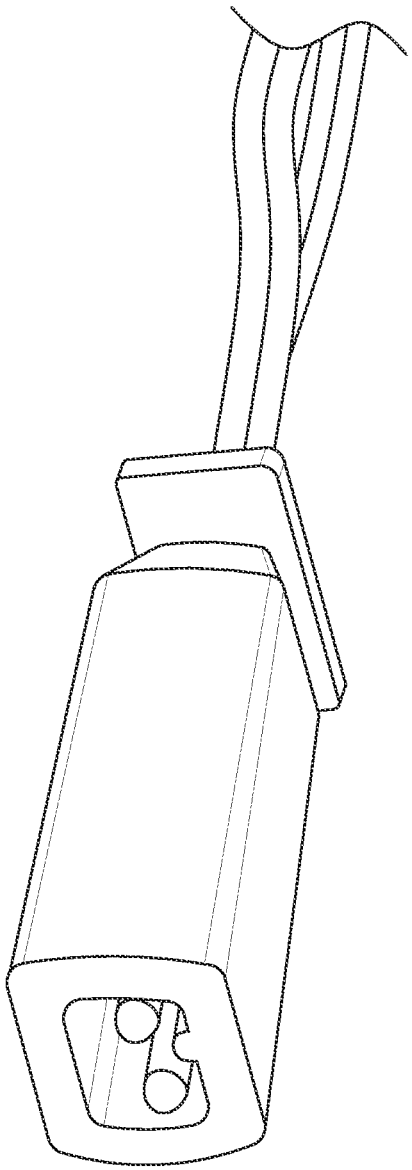
FIG. 10 is an embodiment of a receptacle that mates with the plug of FIG. 9.
Figure 11:
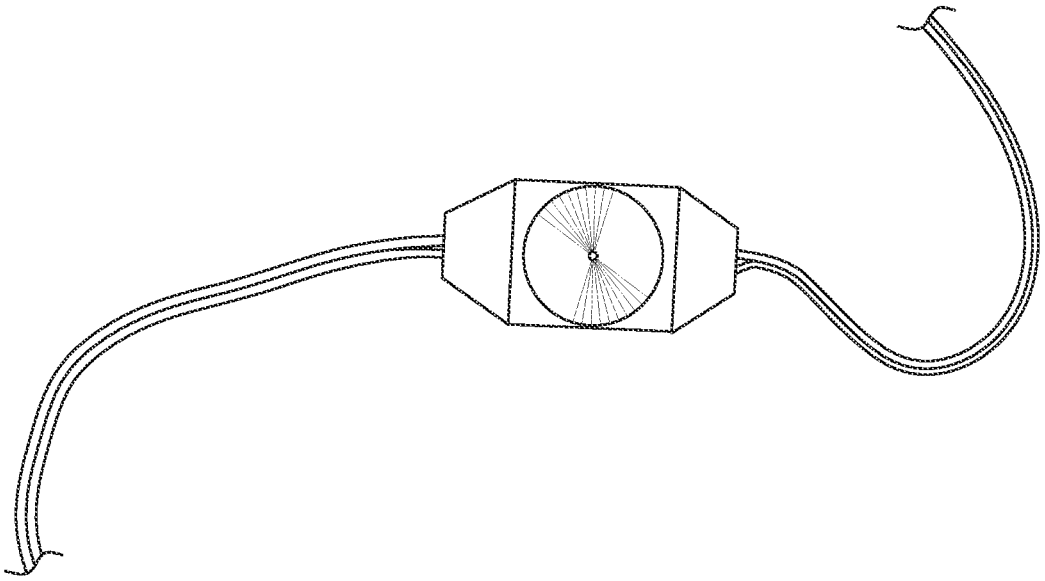
FIG. 11 is a dimmer.

FIGS. 9 and 10 show an alternate embodiment of a plug and receptacle that can used with light strings or can be used to form extension cords. FIG. 11 shows a dimmer that can be placed inline to dim lights by inserting resistance into the circuit, or can be interfaced with the power control device to control its output voltage. However, connected, the dimmer lowers the voltage on a particular supply cable (or on all supply cables).

Figure 12:
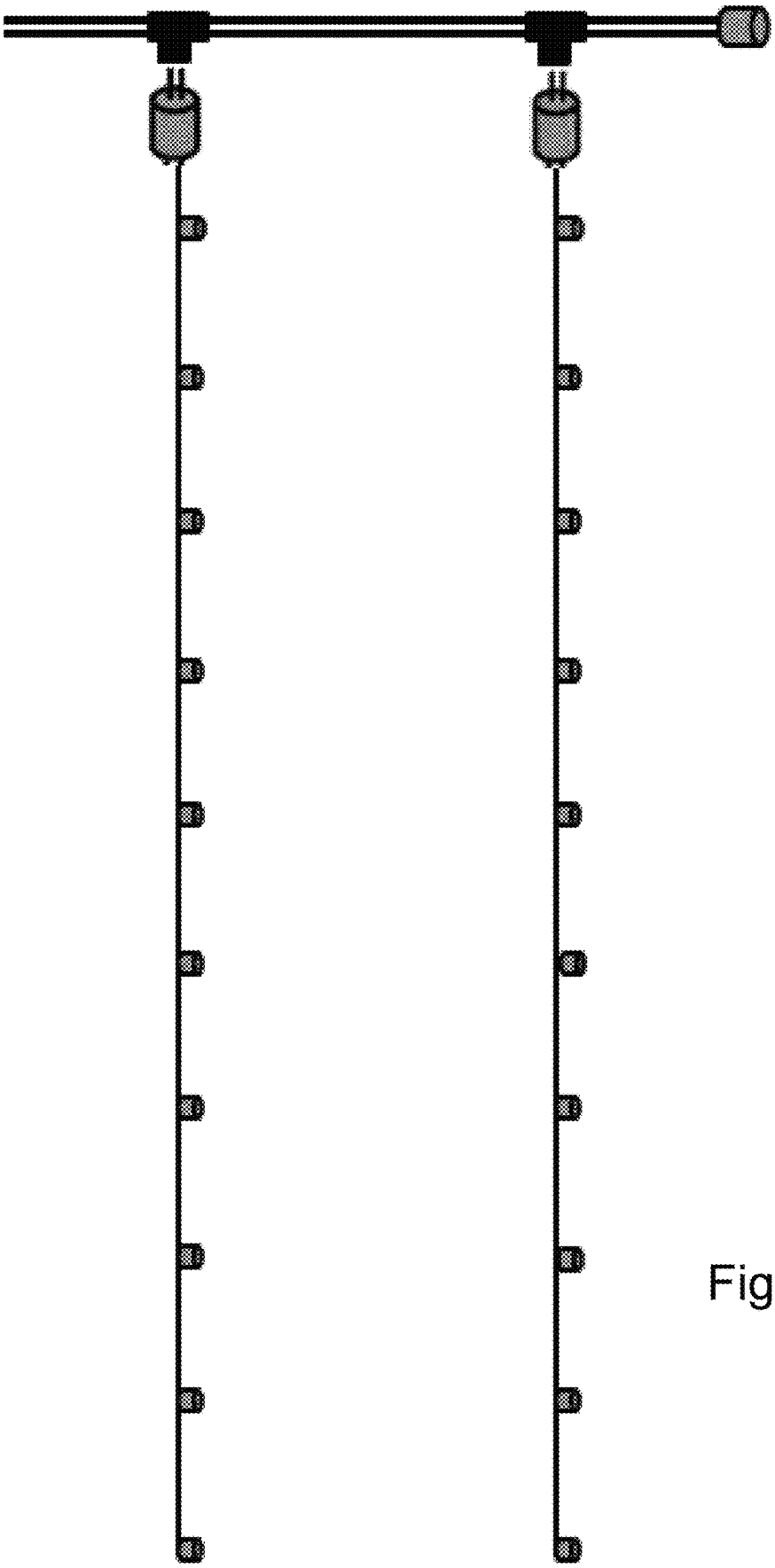
FIG. 12 shows how finger lights can be stringed from a cable.
Figure 13:
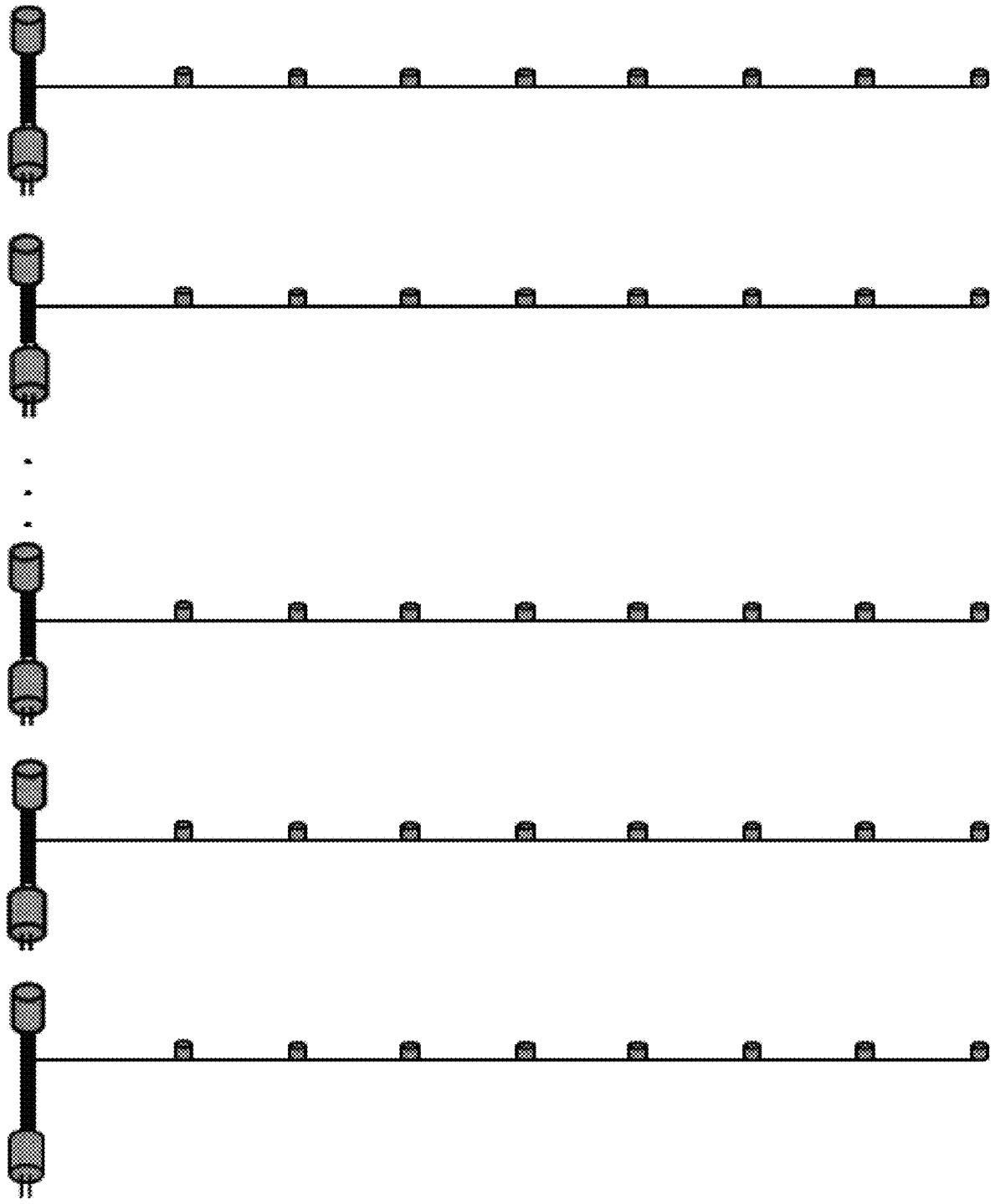
FIG. 13 shows groups of finger lights on separate interconnectable cables.

One of the features of the present invention is the use of finger lights. These are small elongated lights. FIG. 12 shows a section of cable with two splitter units illustrated. Each splitter unit can drive a sting of K finger lights, where K is a positive integer. For the strings shown in FIG. 12, K=10. The present invention works by maintaining a constant voltage on the cable (which may be optionally controlled with a dimmer), and then driving the K finger lights in series to provide the correct voltage across each lamp (which is Vs/K), where Vs is the optionally dimmed cable voltage. All circuits contain two conductors. FIG. 13 shows a tree made of individual cable sections, each having a single fixed connection to a string of finger lights. K in FIG. 13 is 8. An operating principle for these embodiments is that the optionally regulated cable voltage remains constant over a wide range of current draws (plugged in strings). The finger light taps are made onto the cable in parallel, while the finger light strings are wired in series.

Several descriptions and illustrations have been provided to aid in understanding the present invention. One with skill in the art will realize that numerous changes and variations may be made without departing from the spirit of the invention. Each of these changes and variations is within the scope of the present invention.

I claim:

1. A lighting system for an artificial decoration comprising:

a first plurality of sub-strings of luminaries with each sub-string having N luminaries wired in series, where N is a positive integer; each sub-string having a male plug, and each sub-string requiring a particular operating voltage across its male plug to light the N luminaries;

a second at least one sub-string of luminaries with each sub-string having a number different from N luminaries wired in series, where the number different from N is a positive integer; each sub-string having a male plug, and each sub-string requiring a particular operating voltage across its male plug to light the number different from N luminaries;

a master power device configured to supply the particular operating voltage to each of the first plurality of and second at least one sub-strings required by that sub-string; the master power device having a female receptacle configured to match the male plug;

an extender cable having a proximal end and at least one parallel split into a plurality of distal ends, wherein the proximal end has a male plug configured to match the female receptacle, and each of the distal ends has a female receptacle configured to match the male plug;

wherein, the extender cable can be connected to the master power device, and each distal end of the extender cable can be connected to a sub-string of luminaries or to another extender cable.

2. The lighting system of claim 1 wherein N=10.

3. The lighting system of claim 1 wherein the particular voltage required by at least one sub-string is approximately 30 volts.

4. The lighting system of claim 1 wherein all of the male plugs are identical and all of the female receptacles are identical.

5. The lighting system of claim 1, wherein at least one of the sub-strings is a finger light sub-string.

6. The lighting system of claim 1, wherein the master power device includes a dimmer.

7. A lighting system for an artificial decoration comprising:

a first plurality of sub-strings of luminaries, each sub-string having two conductors, with each sub-string having N luminaries wired in series, where N is a positive integer; each sub-string having a 2-prong male plug, and each sub-string requiring a particular operating voltage across its 2-prong male plug to light the N luminaries;

a second at least one sub-string of luminaries, each sub-string having two conductors, with each sub-string having a number different from N luminaries wired in series, where the number different from N is a positive integer; each sub-string having a 2-prong male plug, and each sub-string requiring a particular operating voltage across its 2-prong male plug to light the number different from N luminaries;

a master power device configured to supply the particular operating voltage required by each individual sub-string of the first plurality of and second at least one sub-strings; the master power device having a 2-prong female receptacle configured to match the 2-prong male plug;

a two conductor extender cable having a proximal end and at least one parallel split into a plurality of two conductor distal ends, wherein the proximal end has a two-prong male plug configured to match the 2-prong female receptacle, and each of the distal ends has a two-prong female receptacle configured to match the 2-prong male plug;

the master power device including a dimmer;

wherein, the two conductor extender cable can be connected to the master power device, and each distal end of the two conductor extender cable can be connected to a sub-string of luminaries or to another extender cable; and wherein, at least one of the first plurality of or second at least one sub-strings is a finger light string.

8. The lighting system of claim 7 wherein N=10.

9. The lighting system of claim 7 wherein the particular operating voltage is determined by the number of luminaries in the sub-string.

10. The lighting system of claim 7 wherein the particular operating voltage does not exceed 50 volts.

11. The lighting system of claim 7 wherein the particular operating voltage is approximately 30 volts.

12. The lighting system of claim 7 wherein at least one of the luminaries is an LED.

13. The lighting system of claim 7 further comprising the extender cable having two parallel splits.

14. The lighting system of claim 13 wherein the two parallel splits are tandem with a first split into four and a second split into three.

15. The lighting system of claim 7 wherein the master power device includes a 2-prong 120 volt AC home wiring interface, and its output is approximately 30 volts.

16. The lighting system of claim 15 wherein the master power device maintains an output of approximately 30 volts DC over a predetermined range of current loads.

17. The lighting system of claim 7 wherein all of the 2-prong male plugs are identical and all of the 2-prong female receptacles are identical.

18. The lighting system of claim 17 wherein each of the 2-prong male plugs are keyed to fit into the 2-prong receptacles with only one possible polarity.

* * * * *